United States Patent [19]

Baldwin

[11] Patent Number: 4,589,656

[45] Date of Patent: May 20, 1986

[54] AEROBIC EXERCISE DEVICE FOR INCREASED USER COMFORT

[75] Inventor: Dan D. Baldwin, Independence, Va.

[73] Assignee: Nautilus Sports/Medical Industries, Inc., Lake Helen, Fla.

[21] Appl. No.: 668,984

[22] Filed: Nov. 7, 1984

[51] Int. Cl.[4] ..... A63B 69/16

[52] U.S. Cl. ..... 272/73; 297/180; 415/124

[58] Field of Search ..... 272/73, 130, 73.2; 128/25 R, 33; 297/180, 453; 415/124

[56] References Cited

U.S. PATENT DOCUMENTS

| | | | |
|---|---|---|---|
| 681,565 | 8/1901 | McCune et al. | 272/73 X |
| 2,255,864 | 9/1941 | Stephens | 272/73 |
| 2,758,532 | 8/1956 | Awe | 297/180 X |
| 2,788,211 | 4/1952 | Ivanoff . | |
| 2,826,135 | 3/1958 | Benzick | 297/180 X |
| 3,283,997 | 11/1966 | Bambenek et al. | 272/73 X |
| 3,550,523 | 5/1969 | Segal . | |
| 3,712,613 | 1/1973 | Feather et al. | 128/25 R |
| 3,751,033 | 8/1973 | Rosenthal . | |
| 4,082,264 | 4/1978 | Santos | 272/73 |
| 4,140,312 | 2/1979 | Buchmann | 272/73 |
| 4,285,515 | 8/1981 | Gezari . | |
| 4,358,105 | 11/1982 | Sweeney, Jr. | 272/73 |
| 4,372,551 | 2/1983 | Yurdin . | |
| 4,537,396 | 8/1985 | Hooder | 272/130 |

FOREIGN PATENT DOCUMENTS

| | | | |
|---|---|---|---|
| 121186 | 10/1984 | European Pat. Off. | 272/73 |
| 800679 | 5/1936 | France | 272/73.2 |
| 6738 | of 1894 | United Kingdom | 272/130 |

*Primary Examiner*—Richard J. Apley
*Assistant Examiner*—Robert W. Bahr
*Attorney, Agent, or Firm*—Bell, Seltzer, Park & Gibson

[57] ABSTRACT

A device for aerobic exercise characterized by increased user comfort, especially during extended periods of use which comprises an elongate frame, a housing enclosing the frame, a stress imposing pedal-driven fan carried by one end portion of the frame and a user supporting and positioning seat carried by the other end portion of the frame opposite the fan and comprising a seat portion inclined from front to rear at a predetermined acute angle to the horizontal, and a backrest portion inclined at a predetermined acute angle to the vertical, with at least the backrest portion having ventilation openings therein which communicate with the front and rear surfaces of the backrest portion. Air passages communicate with the discharge side of the fan and also with the ventilation openings in the backrest portion and serve for directing air discharged by the fan through the ventilation openings to the forward surface of the backrest portion and outwardly therefrom whereby the air cools the user and substantially increases the user's comfort, particularly during long periods of use.

12 Claims, 7 Drawing Figures

AEROBIC EXERCISE DEVICE FOR INCREASED USER COMFORT

FIELD OF THE INVENTION

The present invention relates to exercise devices, and in particular to devices for providing aerobic-type exercise wherein a user may remain stationary on said device while repeatedly moving particular portions of the body at relatively rapid rates for relatively long periods of time to thereby obtain benefits to the cardiovascular system.

BACKGROUND OF THE INVENTION

Aerobic exercise may be defined as rapid repetitive movement of major body portions, particularly the arms and legs, so as to produce a rapid heartbeat and an increased rate of respiration. In general, aerobic exercise beneficial to the cardiovascular system requires that the rapid heartbeat and increased respiratory rate be maintained for relatively extended periods of time, generally at least twenty minutes up to an hour or more.

It will be noted that there are many recognized methods of obtaining aerobic exercise, such as running, swimming, bicycling, rapid calisthenics and the like. However, while these methods are quite popular, there still remains a need for methods of obtaining aerobic exercise where the other methods are inconvenient or not available, such as, for example, where outdoor activities are limited because of weather, general surroundings such as city streets, the particular time of day, e.g. after nightfall, and the like. Other aerobic exercises, such as swimming or racquet sports, require pools or specialized court facilities which are oftentimes either crowded or unavailable.

Exercise devices attempting to provide appropriate solutions to the aforementioned problems have been proposed. The most common of these devices are treadmills, "rowing" machines and stationary bicycle-like devices. Treadmills have become a popular method of testing cardiac capabilities within a medical setting, but have not achieved great popularity as pure exercise devices, probably because the activity so resembles walking, jogging or running. Rowing machines are somewhat more popular, but are primarily designed and used to provide anaerobic exercise such as development of leg and upper body muscles rather than more pure aerobic exercise in which the object is to raise the cardiovascular rate to a relatively high level for a relatively long period of time regardless of the strengthening obtained by various muscle groups.

The stationary bicycle-like devices usually comprise a traditional bicycle seat, bicycle handlebars, a bicycle frame and pedals located in the same relationship to the seat and the handlebars as pedals would be on an actual bicycle. Such bicycle-like devices do provide desirable aerobic exercise, but are not always suitable for the extended periods of exercise required to obtain the maximum benefits of aerobic exercise by most users. For example, some authorities recommend at least three periods of aerobic exercise per week, each extending for at least twenty minutes before cardiovascular improvement can be expected. Other authorities would consider such amounts relatively small and would recommend up to an hour a day for five or six days per week as a more desirable level of aerobic exercise. The narrow bicycle-type seat and the positioning of the handlebars, while necessary for the operation of an actual bicycle, are not particularly desirable for a device which is to remain stationary, and are unsuitable for extended periods of use.

With the foregoing in mind, it is an object of the present invention to provide a device upon which strenuous aerobic exercise can be obtained for extended periods of time while providing a much higher degree of comfort than has previously been the case.

SUMMARY OF THE INVENTION

The object of the present invention is accomplished by providing an aerobic exercise device, characterized by increased user comfort, especially during extended periods of use, which comprises an elongate frame, a housing enclosing the frame, stress imposing means carried by one end portion of the frame which includes pedal-driven fan means which imposes the stress on the user, and user supporting and positioning means carried by the other end portion of the frame opposite the stress imposing means and comprising a seat portion inclined from front to rear at a predetermined acute angle to the horizontal, and a backrest portion inclined at a predetermined acute angle to the vertical, with at least the backrest portion having ventilation openings therein which communicate with the front and rear surfaces of the backrest portion. Finally, air passage means communicate with the discharge side of the fan means and also with the ventilation openings in the backrest portion and serve for directing air discharged by the fan means through the ventilation openings to the forward surface of said backrest portion and outwardly therefrom whereby the air cools the user and substantially increases the user's comfort, particularly during long periods of use. Preferably, the stress imposing means and user supporting and positioning means are disposed relative to each other so that the user's feet are at an elevation no lower than his or her hips and the user is semi-reclining in the supporting and positioning means for further increased comfort.

BRIEF DESCRIPTION OF THE DRAWINGS

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments and wherein.

DESCRIPTION OF THE ILLUSTRATED EMBODIMENT

Figure 1:
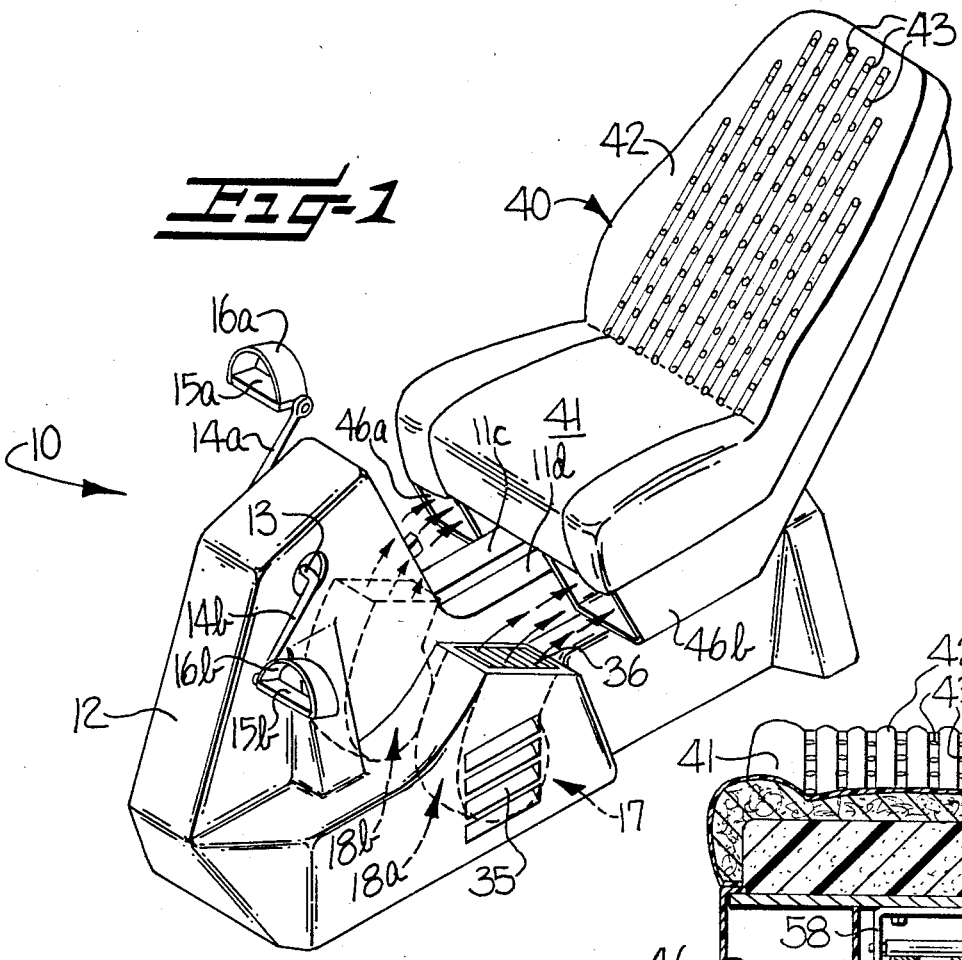
FIG. 1 is a perspective view of an exercise device incorporating the features of the present invention.
Figure 3:
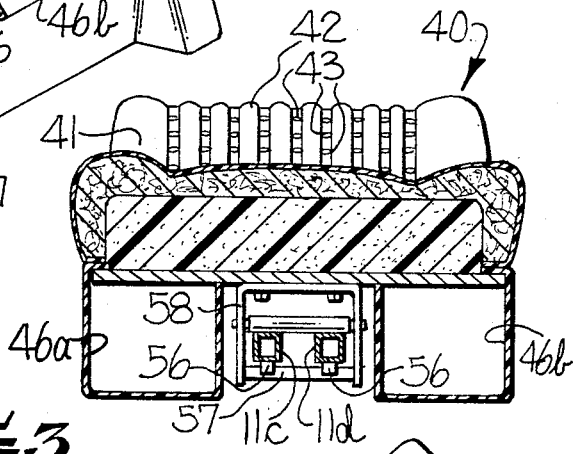
FIG. 3 is a transverse sectional view taken substantially along line 3—3 in FIG. 2.
Figure 2:
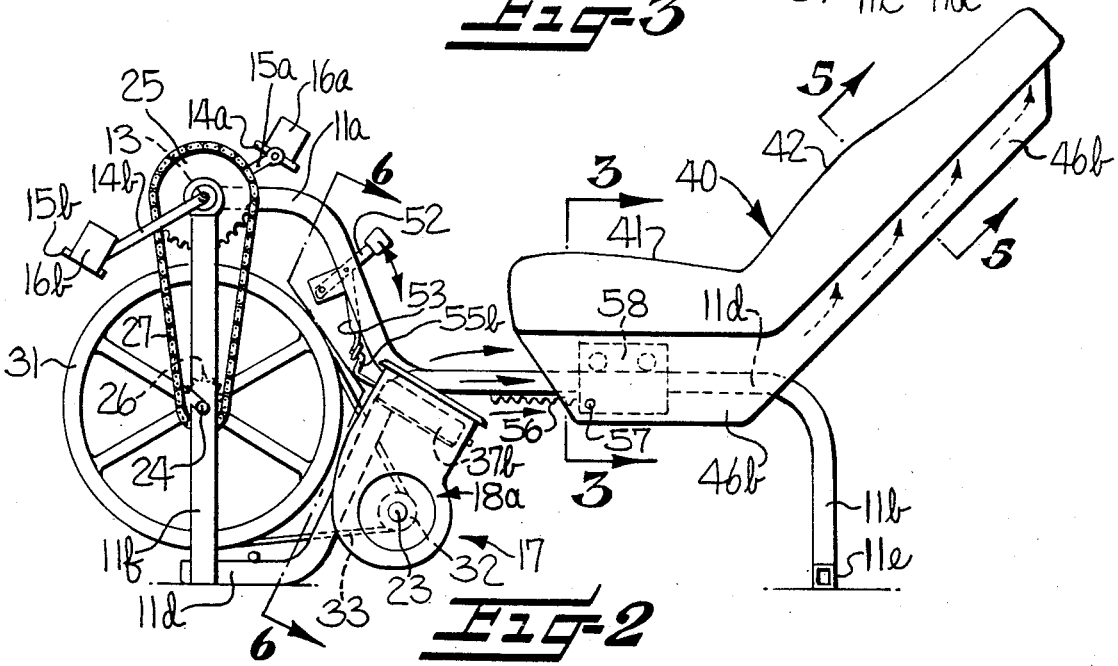
FIG. 2 is a side elevational view of the exercise device shown in FIG. 1 with the housing removed.

Turning to the invention in detail, the aerobic exercise device of the present invention is broadly designated at 10 (FIG. 1). Exercise device 10 comprises an elongate frame 11 having a yoke-like forward end portion 11*a* and a rearward end portion 11*b* (FIG. 2) In the embodiment illustrated in the drawings, the frame is formed from a plurality of suitable structural members, such as metallic tubing having a square cross section (FIG. 3). Preferably, the frame 11 comprises a longitudinal pair of such structural members 11*c*, 11*d* extending from the forward end of the exercise device 10 to the rearward end, and forming an elongated, inverted U-shape. The forward end portions of structural members 11*c*, 11*d* are bent so as to extend horizontally and a horizontal cross member 11*e* is secured to the ends of members 11*c*, 11*d* at their rearward ends. The horizontal forward end portions of frame members 11*c*, 11*d* and cross member 11*e* are adapted to rest on a floor or the like, to support exercise device 10 thereon. Frame 11 further includes a pair of upright standards 11*f*, 11*g* connected to the forward ends of frame members 11*c*, 11*d*, respectively, (FIG. 4) and a brace member 11*b* connecting the upper ends of standards 11*f*, 11*g* to medial portions of frame members 11*c*, 11*d* (FIG. 2).

A housing 12 encloses the frame 11 and provides an overall aesthetic appearance to the exercise device 10. Housing 12 also isolates the moving parts of exercise device 10 from interference with the user or other animate or inanimate objects. It will be understood that housing 12 may be produced from several types of materials by known methods and that the particular nature of the material forming the housing does not constitute a part of the present invention. Similarly, while the shape of the housing 12 combines both aesthetic and functional qualities, it will be understood that the particular shape could be altered somewhat without departing from the spirit or scope of the present invention.

In order to provide the desired aerobic exercise and associated cardiovascular benefits, exercise device 10 includes stress imposing means carried by the forward end portion 11*a* of the frame 11. Preferably, the stress imposing means comprises a shaft 13, (FIGS. 1 and 4) journaled for rotation on the upper ends of standards 11*f*, 11*g* and brace 11*h* of the frame 11, and having opposite ends thereof extending outwardly through opposite sides of the housing 12. Crank arms 14*a* and 14*b* are carried by or integral with opposite ends of the shaft 13 and pedals 15*a* and 15*b* are mounted on the outer ends of the crank arms 14*a* and 14*b*. Preferably, the pedals 15*a*, 15*b* include stirrups 16*a*, 16*b* which can be of assistance in positioning a user's feet on the pedals 15*a* and 15*b*.

Figure 7:
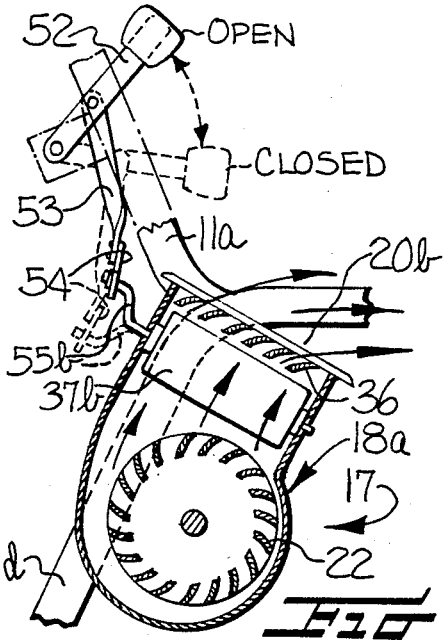
FIG. 7 is a sectional view taken substantially along line 7—7 in FIG. 6.
Figure 6:
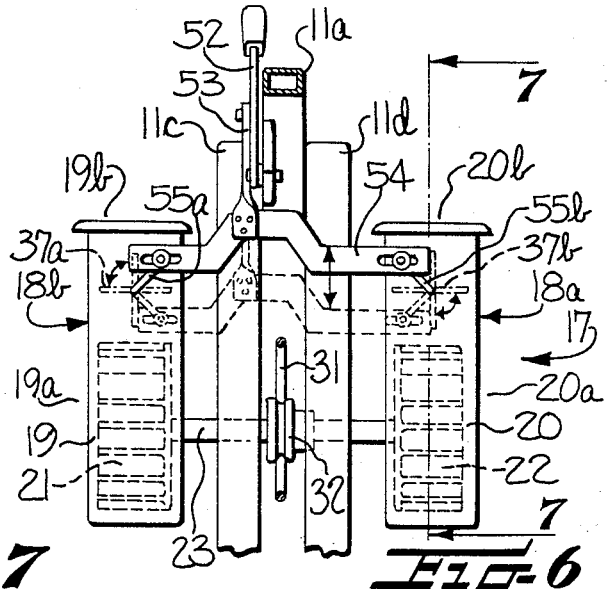
FIG. 6 is a sectional view taken substantially along line 6—6 in FIG. 2.

The stress imposing means further includes fan means 17 positioned within housing 12 and which preferably comprises a pair of fans 18*a*, 18*b* (FIGS. 6 and 7). As illustrated, fans 18*a*, 18*b* are of the squirrel-cage type and each include a housing 19, 20 mounted on frame 11 and having input sides 19*a*, 20*a* and discharge sides 19*b*, 20*b*, respectively. The fans 18*a*, 18*b* further include rotors 21, 22 rotatably mounted within housings 19, 20 by a common shaft 23 extending therebetween.

Figure 4:
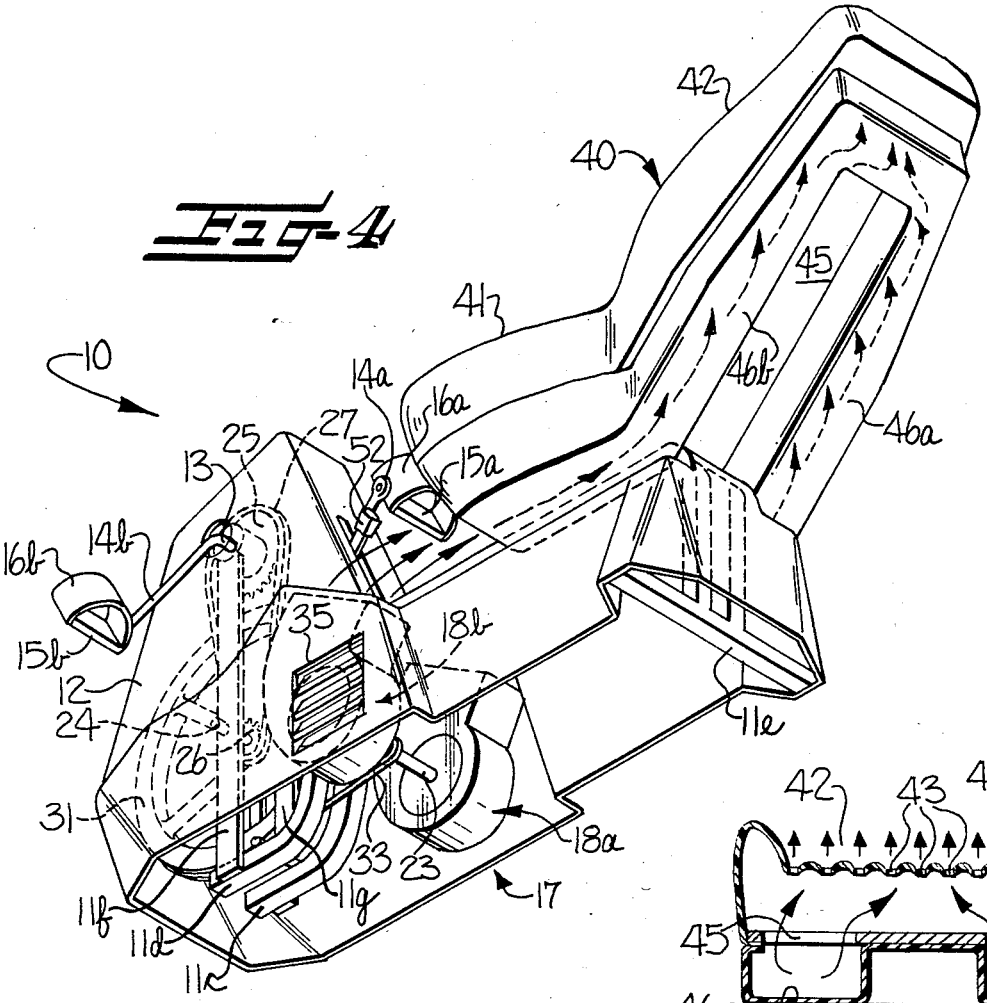
FIG. 4 is a perspective view of the exercise device shown in FIG. 1 looking upwardly into the housing.
Figure 5:
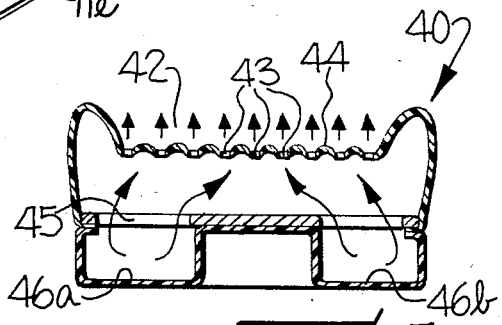
FIG. 5 is a transverse sectional view taken substantially along line 5—5 in FIG. 2.

Fan means 17 is driven by pedals 15*a*, 15*b* by means drivingly connecting the shaft 13 to the common shaft 23 such that fan means 17 applies a load on the shaft 13 and thereby on the pedals 15*a*, 15*b*. The means drivingly connecting shaft 13 to shaft 23 comprises a second shaft 24, mounted on the standards 11*f*, 11*g* below and parallel to shaft 13 (FIGS. 2 and 4). A drive sprocket 25 is mounted on the shaft 13 for rotation therewith and a driven sprocket 26 is similarly mounted on second shaft 24 in driving relation thereto. A chain 27 is positioned about and drivingly connects drive sprocket 25 and driven sprocket 26. A drive pulley 31 is mounted on the second shaft 24 for rotation therewith (FIG. 2) and a driven pulley 32 (FIGS. 2 and 7) is mounted on common shaft 23 between the fans 18*a* and 18*b*. A belt 33 is positioned upon and drivingly connects the drive pulley 31 and the driven pulley 32 such that rotation of drive pulley 31 rotates driven pulley 32, common shaft 23 and fans 18*a*, 18*b*.

It will thus be seen that user rotation of the pedals 15*a* and 15*b* will in turn rotate drive sprocket 25, driven sprocket 26, drive pulley 31, driven pulley 32 and the fans 18*a* and 18*b*. In this manner, the load upon the fans means 17 is mechanically translated into a load upon the pedals 15*a* and 15*b* against which load a user must work and thus obtains aerobic exercise. In the illustrated embodiment of the invention, and as best shown in FIG. 2, the respective sizes of the drive and driven sprockets and the drive and driven pulleys are such that a mechanical disadvantage is imposed on the pedals by the rotation of the fan means 17. In this manner, the inverse mechanical advantage provides an appropriately stressful load against which a user must exercise even though the load is applied by relatively small cylindrical fans moving correspondingly relatively small amounts of air. The present invention thus provides a method of obtaining suitably stressful aerobic exercise using a minimum amount of load at the load source and an appropriate mechanical disadvantage.

In order that air may pass into the fan means 17 and thus provide a load against which an exercising person must work, there are provided air inlet means shown as the louvers 35 carried by the housing 12 (FIGS. 1 and 4). The louvers 35 communicate with the input sides 19*a* and 20*a* of the fans 18*a* and 18*b*, respectively, and supply air thereto. Similarly, air discharge means, shown in the form of shutters 36, are carried by the housing 12 and likewise communicate with the discharge sides 19*b*, 20*b* of the respective fans 18*a* and 18*b* and serve to discharge air from within the housing 12 to the exterior thereof.

In the illustrated embodiment, the louvers 35 are positioned in sides of the housing 12 while the shutters 36 are positioned generally on upper middle portions of the housing 12. It will be understood, however, that the precise location of the air inlet means and the air discharge means may be varied without departing from the spirit and scope of the invention.

In order to vary the stress imposed on a user and thus tailor the degree of exercise, the air discharge means includes means for varying the amount of air which may be discharged by the fan means 17 and thereby vary the load applied to the pedals 15*a* and 15*b*. Preferably, this means for varying the load comprises butterfly valves 37*a* and 37*b*, respectively (FIGS. 2, 6 and 7). In order to move the butterfly valves 37*a* and 37*b* and thereby vary the size of the air discharge openings, manually operable lever means is connected to butterfly valves 37*a*, 37*b* and comprises a handle 52 pivotally connected to an arm 53 which in turn is connected to a bar 54 (FIG. 7), which operates links 55*a* and 55*b*. Links 55*a*, 55*b* are connected respectively to the butterfly valves 37*a* and 37*b* and when operated move the valves between open and closed positions.

User supporting and positioning means 40 is carried by the rear end portion 11*b* of frame 11, and comprises a seat portion 41 inclined from front to rear at a predetermined acute angle to the horizontal, and a backrest portion 42 which is inclined rearwardly from bottom to top at a predetermined angle to the vertical.

Backrest portion 42 has ventilation openings 43 therein which communicate with the front surface 44 and the rear surface 45 of the backrest portion 42. In order to supply air to the backrest portion 42, air passage means is provided and preferably comprises a pair of ducts 46*a* and 46*b* which have the lower end portions thereof positioned under the seat portion 41 on opposite sides of the medial portion of frame 11. The remaining upper portions of ducts 46*a*, 46*b* are positioned along the rear surface of backrest portion 42 and communicate with the ventilation openings 43 in order to deliver air flow through the ventilation openings 43 to the front surface 44 of backrest portion 42.

The ducts 46*a*, 46*b* communicate at their lower ends with the discharge means 36 of the fans 18*a* and 18*b* such that air discharged by the fans, enters the ducts 46*a*, 46*b* and is directed rearwardly beneath seat portion 41 and upwardly along the rear surface 45 of backrest portion 42. The air passes through the ventilation openings 43 to the front surface 44 where it cools the user and substantially increases the user's comfort, particularly during long periods of use.

It will be seen from the drawings that the shutters 36 are so positioned in the housing 12 that air discharged from the fans 18*a* and 18*b* is directed by the shutters 36 externally of and horizontally along the housing 12 into the ducts 46*a* and 46*b*. It will be understood that the present invention is not limited to the illustrated arrangement, but that other types of air passages could be used to communicate with the discharge sides of the fan means 17 in order to accomplish the same result without departing from the spirit or scope of the invention.

Preferably, the seat portion 41 of the user supporting and positioning means 40 and the shaft 13 are positioned on the frame 11 with respect to one another such that the seat portion 41 is not higher than the shaft 13. In this manner a user's feet will be no lower than the user's hips, and in most cases will be higher. The particular relationship between the seat portion 41 and the shaft 13 results in the user being in a semi-reclining position for even greater user comfort for several reasons. First, the seat portion 41 provides broad support for a user's hips, as opposed to typical bicycle-type exercise devices in which a user's hips are not supported but which instead provide a narrow seat which forces the entirety of the user's weight to rest upon the lower portions of the user's spine and upon the user's crotch. This particular weight distribution can be very uncomfortable during extended periods of exercise.

Second, positioning the user's feet at or above the level of the user's hips elevates the feet, provides circulation benefits and greatly increases the freedom of movement of a user's knees and thighs. Consequently, users of the present invention enjoy greatly increased support of body weight and greatly increased freedom of movement during exercise, both of which result in superior comfort and permit extended periods of exercise which would be either very uncomfortable or even intolerable on other types of exercise devices.

Further, the exercise device 10 preferably includes means for adjusting the position of the user supporting and positioning means 40 horizontally along the frame 11 which comprises a rack 56 (FIG. 2) extending longitudinally along and beneath the medial portion of the frame 11. Additionally, there is provided a pin 57 (FIG. 3) which is carried by a channel bracket 58 mounted on the bottom of seat portion 41 and is matingly receivable between the teeth of rack 56. Withdrawal of the pin from between the teeth of the rack 56 permits selective adjustment of the user supporting and positioning means 37 along the frame 11, while the mating reception of the pin 57 into the rack 56 causes the user supporting and positioning means 40 to remain at a selected predetermined location along the frame 11. In this manner, the user suporting and positioning means 40 can be quickly and easily moved forward or backward on the frame 11 to be adjusted to fit a variety of users and to maximize the comfort of individual users.

The foregoing embodiment is to be considered illustrative, rather than restrictive of the invention, and those modifications which come within the meaning and range of equivalents of the claims are to be included therein.

That which is claimed is:

1. A device for aerobic exercise characterized by increased user comfort, especially during extended periods of exercise, said exercise device comprising:

an elongate frame;

a housing enclosing said frame;

stress imposing means carried by one end portion of said frame and comprising:

a shaft journaled for rotation on said frame and extending outwardly through opposite sides of said housing, crank arms carried by opposite ends of said shaft, pedals mounted on the outer ends of said crank arms;

fan means rotatably mounted on said frame within said housing; and means disposed within said housing drivingly connecting said shaft to said fan means such that the driving of said fan means applies a load on said shaft and pedals;

air inlet means carried by said housing and communicating with the input side of said fan means for supplying air to said fan means;

user supporting and positioning means carried by the other end portion of said frame opposite said stress imposing means and comprising a seat portion inclined from front to rear at a predetermined acute angle to the horizontal and a backrest portion inclined at a predetermined acute angle to the vertical, at least said backrest portion having ventilation openings therein communicating with the front and rear surfaces of said backrest portion; and air passage means communicating with the discharge side of said fan means and with said ventilation openings in said backrest portion for directing air discharged by said fan means through said ventilation openings to the forward surface of said backrest portion and outwardly therefrom whereby such air cools the user and substantially increases user comfort, particularly during long periods of use.

2. A device according to claim 1 wherein said seat portion and said shaft are respectively positioned on said frame such that said seat portion is no higher than said shaft whereby a user's feet will be no lower than the user's hips.

3. A device according to claim 1 including means for varying the amount of air which may flow through said fan means to vary the load applied to said pedals and thereby vary the stress imposed on the user.

4. A device for aerobic exercise characterized by increased user comfort, especially during extended periods of exercise, said exercise device comprising:

an elongate frame;

a housing enclosing said frame;

stress imposing means carried by one end portion of said frame and comprising:

a shaft journaled for rotation on said frame and extending outwardly through opposite sides of said housing;

crank arms carried by opposite ends of said shaft; pedals mounted on the outer ends of said crank arms;

fan means rotatably mounted on said frame within said housing; and means disposed within said housing drivingly connecting said shaft to said fan means such that the driving of said fan means applies a load on said shaft and pedals;

air inlet means carried by said housing and communicating with the input side of said fan for supplying air to said fan;

air discharge means carried by said housing and communicating with the discharge side of said fan for discharging air from within said housing to the exterior thereof;

user supporting and positioning means carried by the other end portion of said frame opposite said stress imposing means and comprising a seat portion inclined from front to rear at a predetermined acute angle to the horizontal and a backrest portion inclined at a predetermined acute angle to the vertical, at least said backrest portion having ventilation openings backrest portion;

said seat portion and said shaft being respectively positioned on said frame such that said seat portion is no higher than said shaft, whereby a user's feet will be no lower than the user's hips;

air passage means communicating with the discharge side of said fan means and said ventilation openings in said backrest portion for directing air discharged by said fan means through said ventilation openings to the forward surface of said backrest portion and outwardly therefrom whereby such air cools the user and substantially increases user comfort, particularly during long periods of use; and means for varying the amount of air which may flow through said fan means to vary the load applied to said pedals and thereby vary the stress imposed on the user.

5. A device according to claim 4 wherein said fan means comprises a pair of fans.

6. A device according to claim 4 wherein said means drivingly connecting said shaft to said fan means further comprises:

a second shaft mounted on said frame below and parallel to said first shaft;

a drive sprocket mounted on said first shaft for rotation thereby;

a driven sprocket mounted on said second shaft in driving relationship thereto;

a chain positioned upon said drive and driven sprockets for drivingly connecting said sprockets;

a drive pulley mounted on said second shaft for rotation therewith;

a driven pulley connected to said fan means in driving relationship thereto; and a belt positioned upon said drive and driven pulleys such that user operation of said pedals rotates said sprockets, said pulleys and said fans.

7. An exercise device according to claim 4 wherein said means for varying the amount of air which may flow through said fan means comprises means for varying the size of air pathways through said air discharge means.

8. A device according to claim 7 wherein said means for varying the size of said air discharge means comprises a butterfly valve and lever means associated with said valve such that varying the position of said lever means varies the size of said air discharge openings and varies the amount of air which may flow through said fan.

9. A device for aerobic exercise characterized by increased user comfort, especially during extended periods of exercise, said exercise device comprising:

an elongate frame;

a housing enclosing said frame;

stress imposing means carried by one end portion of said frame and comprising:

a shaft journaled for rotation on said frame and extending outwardly through opposite sides of said housing, crank arms carried by opposite ends of said shaft; pedals mounted on the outer ends of said crank arms;

a pair of fans rotatably mounted opposite one another on respective opposite sides of center portions of said frame within said housing;

means disposed within said housing drivingly connecting said shaft to said fans such that the driving of said fans applies a load on said shaft and pedals;

air inlet means carried on respective opposite lateral portions of said housing, each of said air inlet means communicating with the input side of one of said fans for supplying air to said fan;

a pair of air discharge means carried on said housing, each of said air discharge means communicating with the respective discharge side of one of said fans for discharging air from within said housing to the exterior thereof;

user supporting and positioning means carried by the other end portion of said frame opposite said stress imposing means and comprising a seat portion inclined from front to rear at a portion inclined at a predetermined acute angle to the vertical;

said seat portion and said shaft being respectively positioned on said frame such that said seat portion is no higher than said shaft, whereby a user's feet will be no lower than the user's hips;

said backrest portion of said user supporting and positioning means having ventilation openings therein communicating with the front and rear surfaces of said backrest portion; and air passage means integral with said user supporting and positioning means and communicating with said air discharge means and with said ventilation openings in said backrest portion for directing air discharged by said fan through said ventilation means and through said ventilation openings to the forward surface of said backrest portion and outwardly therefrom whereby such air cools the user and substantially increases user comfort, particularly during long periods of use.

10. A device according to claim 9 wherein said air passage means includes a first portion comprising a pair of ducts, positioned under said seat portion and on opposite sides of said frame; and a second portion positioned along said backrest portion and communicating with said ventilation openings therein to deliver airflow therethrough.

11. A device according to claim 9 including means for moving said user supporting and positioning means horizontally to selected predetermined locations along said frame and for keeping said user supporting and positioning means at said selected predetermined locations during use of the exercise device whereby the user supporting and positioning means may be selectively adjusted relative to said pedals for greatest comfort to individual users.

12. A device according to claim 11 wherein said moving means comprises a rack positioned longitudinally below said seat portion and adjacent said frame; and a pin associated with said seat portion and matingly receivable with said rack, whereby movement of said pin along said rack provides selective adjustment of said user supporting and positioning means and mating reception of said pin in said rack causes said user supporting and positioning means to remain at a selected predetermined location.

* * * * *